US007741997B1

(12) United States Patent
Jacomb-Hood

(10) Patent No.: US 7,741,997 B1
(45) Date of Patent: Jun. 22, 2010

(54) MULTIPLE-BEAM PHASED ARRAY WITH SWITCHABLE ELEMENT AREAS

(75) Inventor: Anthony W. Jacomb-Hood, Yardley, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 979 days.

(21) Appl. No.: 11/505,290

(22) Filed: Aug. 17, 2006

Related U.S. Application Data

(60) Provisional application No. 60/709,274, filed on Aug. 17, 2005.

(51) Int. Cl.
*H01Q 3/24* (2006.01)

(52) U.S. Cl. ..... 342/374

(58) Field of Classification Search ..... 342/374
See application file for complete search history.

(56) References Cited

U.S. PATENT DOCUMENTS 4,837,580 A * 6/1989 Frazita ..... 342/374
5,115,248 A * 5/1992 Roederer ..... 342/373
5,151,706 A * 9/1992 Roederer et al. ..... 342/372
5,929,804 A * 7/1999 Jones et al. ..... 342/354
2003/0134592 A1 * 7/2003 Franzen et al. ..... 455/12.1

* cited by examiner

*Primary Examiner*—Gregory C Issing
(74) *Attorney, Agent, or Firm*—McDermott Will & Emery LLP

(57) ABSTRACT

A phased array antenna system is provided, which includes one or more switchable sub-groups. Each switchable sub-group can be switchably configured to associate one or more waveform signals with one or more of a plurality of controller circuits using a first switching network, and to associate one or more of the plurality of controller circuits with one or more of a plurality of antenna elements using a second switching network. The switching networks permit a phased array antenna system to switchably control one or more beams, with different scanning ranges and coverage areas depending upon mission requirements.

18 Claims, 12 Drawing Sheets

100
101
103a
103b
201
202
204
1 : 2
203
103
205
206
103c
105a
103d
104a
104
104b
105
106
105b
106a
106b
301
302
2 : 1
303
1 : 2
304
305
306
307
308
310
311
312
309
1 : 2
1 : 2
1 : 2
1 : 2
313
314
315
316
106c
106d
106e
106f
107
108
109
110

MULTIPLE-BEAM PHASED ARRAY WITH SWITCHABLE ELEMENT AREAS

CROSS-REFERENCE TO RELATED APPLICATION

The present application claims the benefit of priority under 35 U.S.C. §119 from U.S. Provisional Patent Application Ser. No. 60/709,274 entitled "MULTI-BEAM PHASED ARRAY WITH SWITCHABLE ELEMENT AREAS," filed on Aug. 17, 2005, the disclosure of which is hereby incorporated by reference in its entirety for all purposes.

STATEMENT REGARDING FEDERALLY SPONSORED RESEARCH OR DEVELOPMENT

Not applicable.

FIELD OF THE INVENTION

The present invention generally relates to phased arrays and, in particular, relates to phased arrays with switchable element areas.

BACKGROUND OF THE INVENTION

Phased array antenna systems are used to provide control over one or more beams transmitted or received thereby. The amount of electronics with which a phased array antenna system must be populated to provide beam forming and beam steering functions adds to the cost, power consumption, and mass of the system.

One approach to reducing the amount of electronics with which a phased array antenna system must be provided has been to reduce the number of individual antenna elements in the system. If this approach is implemented while maintaining a fixed antenna area, it irrevocably reduces the scanning range and coverage area of the system.

Accordingly, there is a need to reduce the number of electronics with which a phased array antenna system must be populated while preserving the scanning range of the system. The present invention satisfies this need and provides other advantages as well.

SUMMARY OF THE INVENTION

In accordance with the present invention, a phased array antenna system includes one or more switchable sub-groups which can be switchably configured to associate one or more waveform signals with one or more of a plurality of controller circuits using a first switching network, and to associate one or more of the plurality of controller circuits with one or more of a plurality of antenna elements using a second switching network. The switching networks permit a phased array antenna system to switchably control one or more beams, with different scanning ranges and coverage areas, depending upon mission requirements.

According to one embodiment of the present invention, a phased array antenna system includes one or more switchable sub-groups. Each switchable sub-group includes M controller circuits, where M is a positive integer greater than one. Each controller circuit has a controller input and a controller output. Each switchable sub-group further includes a first switching network having X first network inputs, where X is a positive integer greater than one. Each first network input is configured to receive a waveform signal. The first switching network has M first network outputs, each first network output corresponding to one of the M controller inputs. The first switching network is configured to switchably associate one or more of the waveform signals with one or more of the M controller circuits by switchably associating connections between the X first network inputs and the M first network outputs. Each switchable sub-group further includes N antenna elements, where N is a positive integer greater than one, and a second switching network disposed between the M controller circuits and the N antenna elements. The second switching network has M second network inputs, each second network input corresponding to one of the M controller outputs. The second switching network has N second network outputs, each second network output corresponding to one of the N antenna elements. The second switching network is configured to switchably associate one or more of the M controller circuits with one or more of the N antenna elements by switchably associating connections between the M second network inputs and the N second network outputs.

According to another embodiment of the present invention, a phased array antenna system includes one or more switchable sub-groups. Each switchable sub-group includes N antenna elements, where N is a positive integer greater than one. Each antenna element is configured to receive an input signal. Each switchable sub-group further includes M controller circuits, where M is a positive integer greater than one. Each controller circuit has a controller input and a controller output. Each switchable sub-group further includes a first switching network disposed between the N antenna elements and the M controller circuits. The first switching network has N first network inputs, each first network input corresponding to one of the N antenna elements. The first switching network has M first network outputs, each first network output corresponding to one of the M controller circuits. The first switching network is configured to switchably associate one or more of the N antenna elements with one or more of the M controller circuits by switchably associating connections between the N first network inputs and the M first network outputs. Each switchable sub-group further includes a second switching network having M second network inputs, each second network input corresponding to one of the M controller outputs. The second switching network has X second network outputs, where X is a positive integer greater than one. Each second network output is configured to output a waveform signal. The second switching network is configured to switchably associate one or more of the M controller circuits with one or more of the waveform signals by switchably associating connections between the M second network inputs and the X second network outputs.

According to another embodiment of the present invention, a phased array antenna system includes one or more switchable sub-groups. Each switchable sub-group includes M controller circuits, where M is a positive integer greater than one. Each controller circuit having a controller input and a controller output. Each switchable sub-group further includes a first switching network having X first network inputs, where X is a positive integer greater than one. Each first network input is configured to receive a waveform signal. The first switching network having M first network outputs, each first network output corresponding to one of the M controller inputs. Each switchable sub-group further includes N antenna elements, where N is a positive integer greater than one, and a second switching network disposed between the M controller circuits and the N antenna elements. The second switching network has M second network inputs, each second network input corresponding to one of the M controller outputs. The second switching network has N second network outputs, each second network output corresponding to one of the N antenna elements. The phased array antenna system further includes one or more processors configured to perform the steps of switchably associating, in the first switching network of each switchable sub-group, one or more of the waveform signals with one or more of the M controller circuits by switchably associating connections between the X first network inputs and the M first network outputs, and switchably associating, in the second switching network of each switchable sub-group, one or more of the M controller circuits with one or more of the N antenna elements by switchably associating connections between the M second network inputs and the N second network outputs.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

Figure 1:
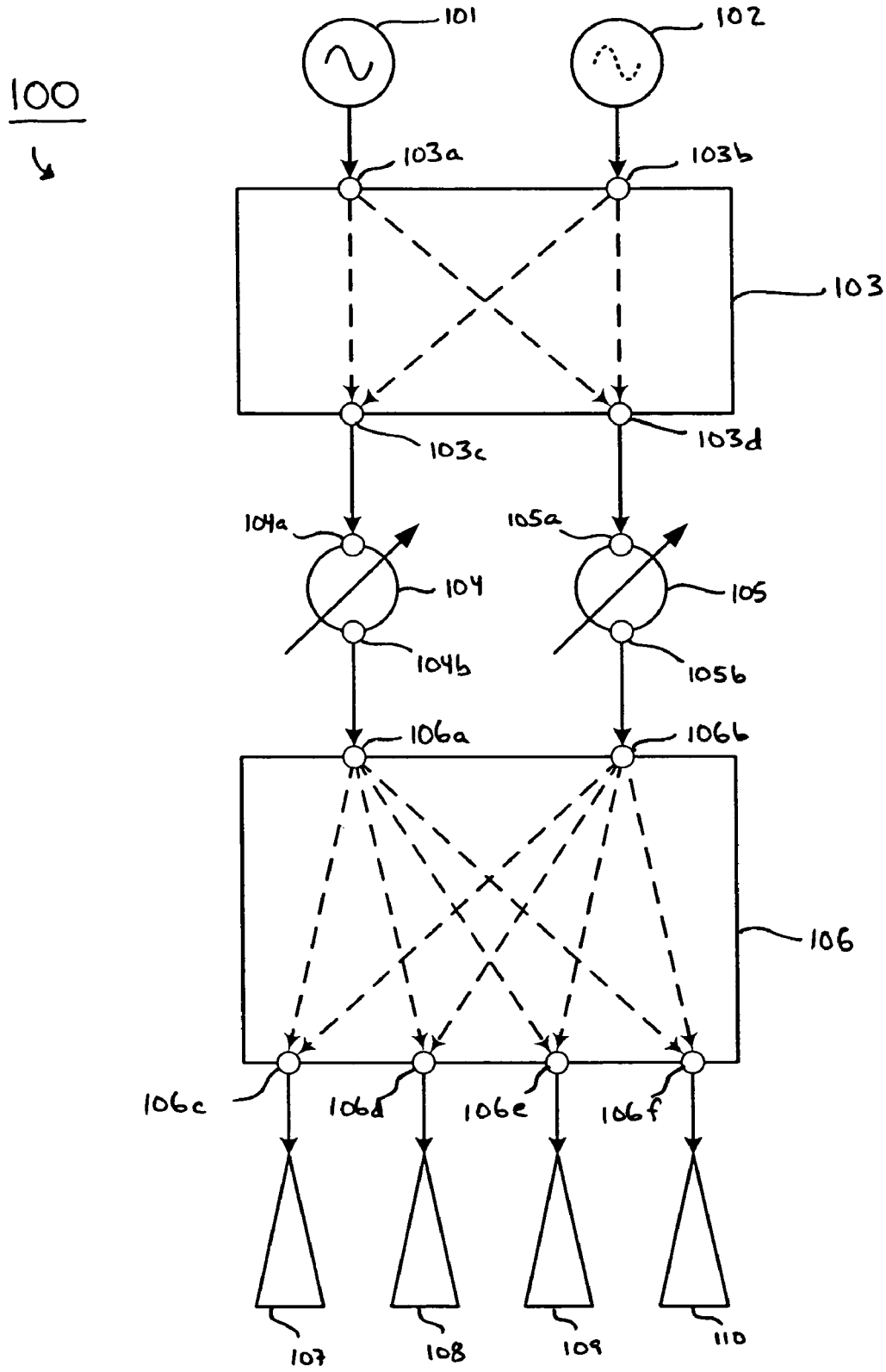
FIG. 1 depicts a switchable sub-group according to one embodiment of the present invention.

In accordance with one embodiment of the present invention, a phased array antenna system includes a number of switchable sub-groups. FIG. 1 depicts one such switchable sub-group 100 according to one aspect of the present invention. A first switching network 103 has first network inputs 103*a* and 103*b*, which are each configured to receive a corresponding waveform signal 101 and 102. Waveform signal 102 is illustrated with a dashed line to indicate that in some arrangements, waveform signal 102 will not be present, as is described more fully below. First switching network 103 also includes first network outputs 103*c* and 103*d*, which can be switchably associated with first network inputs 103*a* and 103*b*. By switchably associating connections (indicated with dashed lines) between first network inputs 103*a* and 103*b* and first network outputs 103*c* and 103*d*, first switching network 103 can switchably associate one or both of waveform signals 101 and 102 with one or both of the controller circuits 104 and 105. An exemplary embodiment of first switching network 103 will be illustrated in greater detail below, with respect to FIG. 2.

Controller circuits 104 and 105 each have corresponding controller inputs 104*a* and 105*a* and controller outputs 104*b* and 105*b*. Each first network output 103*c* and 103*d* is coupled with a corresponding one of the controller inputs 104*a* and 105*a*. Each controller output 104*b* and 105*b* is coupled with a corresponding second network input 106*a* and 106*b* on the second switching network 106.

According to one embodiment, controller circuits 104 and 105 are variable phase and gain controllers which control the phase and gain of waveform signals 101 and 102. According to other embodiments, however, controller circuits in a switchable sub-group of the present invention may be configured to control other attributes of the waveform signals, such as phase only, gain only, time delay, time delay and gain, and the like.

Second switching network 106 further includes a number of second network outputs 106*c-f*, which can be switchably associated with second network inputs 106*a* and 106*b*. By switchably associating connections (indicated with dashed lines) between second network inputs 106*a* and 106*b* and second network outputs 106*c-f*, second switching network 106 can switchably associate one or both of controller circuits 104 and 105 with one or more of the antenna elements 107-110. An exemplary embodiment of second switching network 106 will be illustrated in greater detail below, with respect to FIG. 3.

Figure 2:
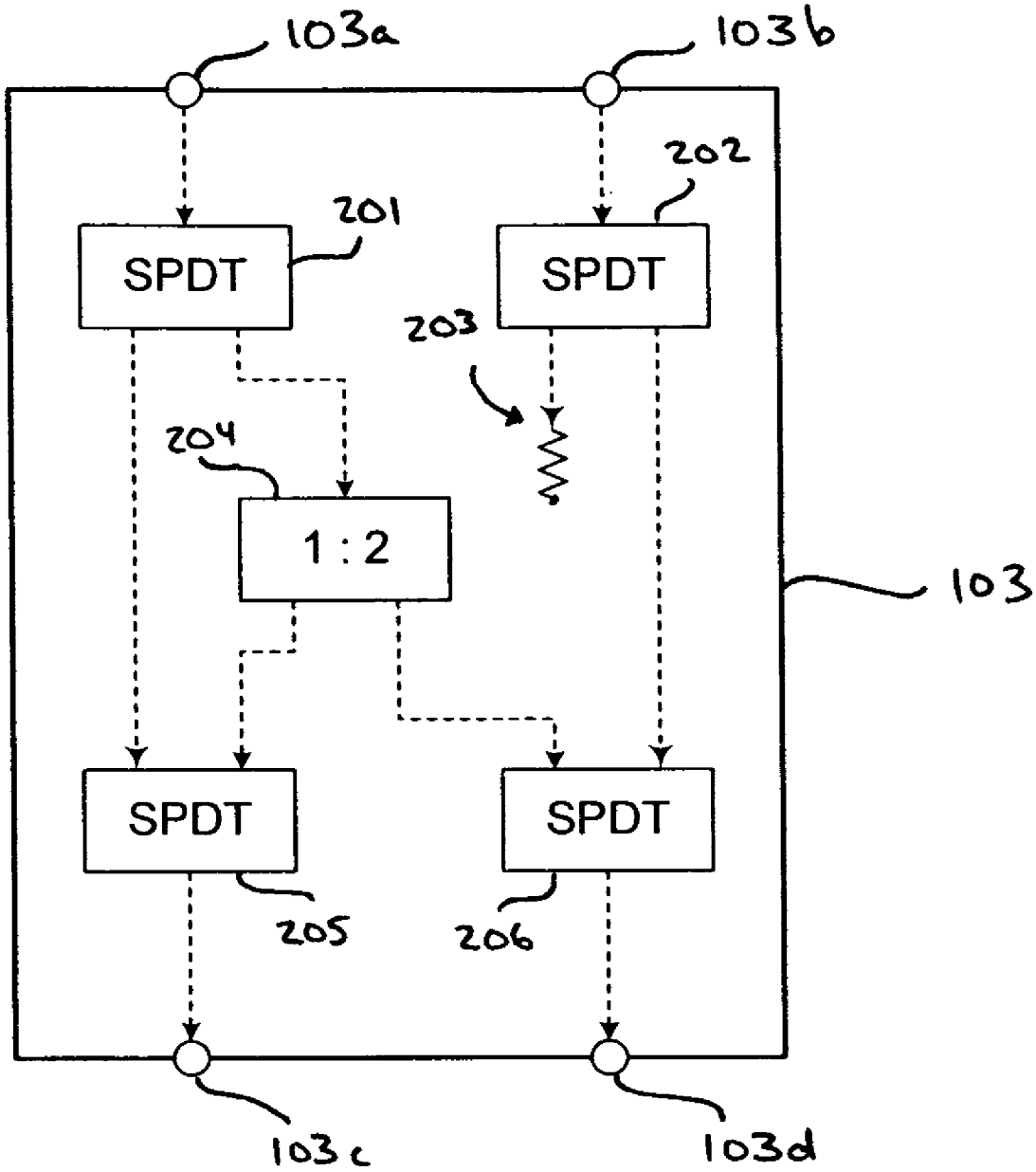
FIG. 2 depicts a first switching network in greater detail, according to one aspect of the present invention.

Turning to FIG. 2, first switching network 103 is illustrated in greater detail, according to one embodiment of the present invention. Each first network input 103*a* and 103*b* of first switching network 103 routes a waveform signal supplied thereto to a corresponding single input of single pole, double terminal ("SPDT") switch 201 and 202, respectively. The two outputs of SPDT switch 201 are coupled with one of two inputs of another SPDT switch 205 and the single input of a 1:2 divider 204, respectively. The two outputs of divider 204 are coupled with one of the two inputs of SPDT switch 205 and one of the two inputs of SPDT switch 206, respectively. The two outputs of SPDT switch 202 are connected to a terminator, such as resistor 203, and one of the two inputs of SPDT switch 206, respectively. The single outputs of each of SPDT switches 205 and 206 are coupled to first network outputs 103*c* and 103*d*, respectively.

According to the present exemplary embodiment, when both waveform signals 101 and 102 are present and are supplied to a corresponding one of first network inputs 103*a* and 103*b*, each of SPDT switches 201 and 202 are configured to route the corresponding waveform signal to a corresponding one of SPDT switch 205 and 206, such that waveform signal 101 is passed from first network input 103*a* to first network output 103*c*, and waveform signal 102 is passed from first network input 103*b* to first network output 103*d*. When only waveform signal 101 is provided, however, SPDT switch 201 is configured to route waveform signal 101 to divider 204, which in turn provides the waveform signal to both SPDT switches 205 and 206. In this manner, waveform signal 101 can be provided to both first network outputs 103*c* and 103*d*.

While in the present exemplary embodiment, first network inputs 103*a* and 103*b* are illustrated as separate structures from the inputs of SPDT switches 201 and 202, and first network outputs 103*c* and 103*d* are illustrated as separate structures from the outputs of SPDT switches 205 and 206, the scope of the present invention is not limited to such an arrangement. Rather, as will be apparent to one of skill in the art, the inputs and outputs of a switching network may not be separate structures, but rather the various inputs and outputs of components of the switching network.

Figure 3:
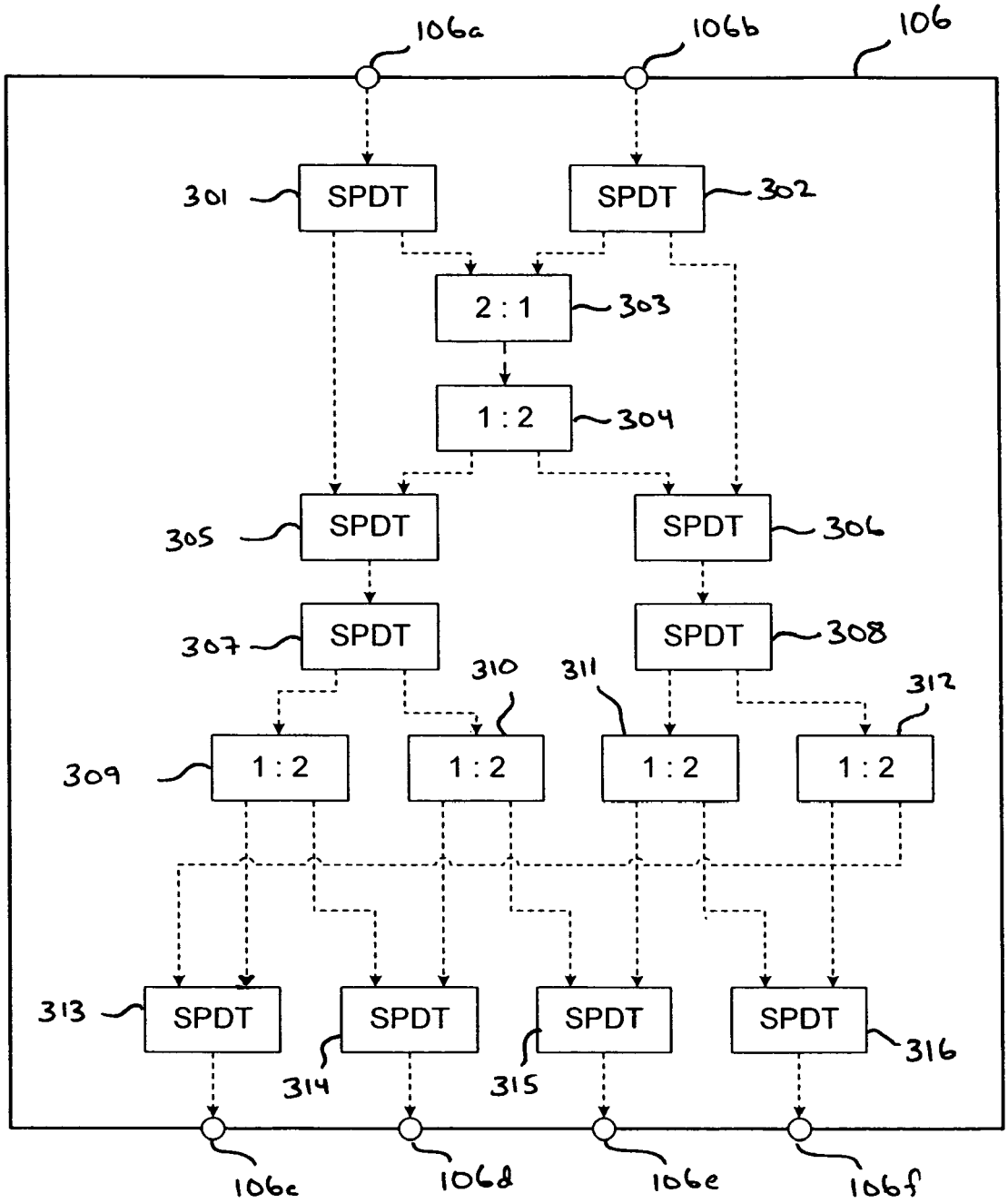
FIG. 3 depicts a second switching network in greater detail, according to one aspect of the present invention.

Turning to FIG. 3, second switching network 106 is illustrated in greater detail, according to one embodiment of the present invention. Each second network input 106*a* and 106*b* of second switching network 106 routes a waveform signal supplied thereto to a corresponding single input of SPDT switch 301 and 302, respectively. The two outputs of SPDT switch 301 are coupled with one of the two inputs of another SPDT switch 305 and one of the two inputs of a 2:1 combiner 303, respectively. The two outputs of SPDT switch 302 are coupled with one of the two inputs of combiner 303 and one of the two inputs of another SPDT switch 306, respectively. The single output of combiner 303 is coupled with the single input of a 1:2 divider 304. The two outputs of divider 304 are coupled with one of the two inputs of each of SPDT switches 305 and 306, respectively. The single outputs of SPDT switches 305 and 306 are coupled to the single inputs of SPDT switches 307 and 308, respectively. The two outputs of SPDT switch 307 are each coupled to a single input of one of 1:2 dividers 309 and 310. The two outputs of SPDT switch 308 are each coupled to a single input of one of 1:2 dividers 311 and 312. The two outputs of divider 309 are coupled to one of the two inputs of each of SPDT switches 313 and 314. The two outputs of divider 310 are coupled to one of the two inputs of each of SPDT switches 314 and 315. The two outputs of divider 311 are coupled to one of the two inputs of each of SPDT switches 315 and 316. The two outputs of divider 312 are coupled to one of the two inputs of each of SPDT switches 316 and 313. Each of the single outputs of SPDT switches 313-316 are coupled to a corresponding one of second network outputs 106*c*-106*f*.

According to the present exemplary embodiment, second switching network 106 can switchably associate second network inputs 106*a* and 106*b* with four, two, or none of second network outputs 106*c*-106*f*, as is illustrated in greater detail with respect to FIGS. 4 and 6, below.

While the present exemplary embodiment has described first and second switching networks 103 and 106 with reference to a specific arrangement of components, the scope of the present invention is not limited to this arrangement. Rather, any switching network capable of switchably associating one or more inputs with one or more outputs may be used, as will be apparent to one of skill in the art. For example, according to one embodiment of the present invention, the switching functions of both first and second switching networks 103 and 106 may be provided in the digital domain by software, firmware, or hardware.

Figure 4:
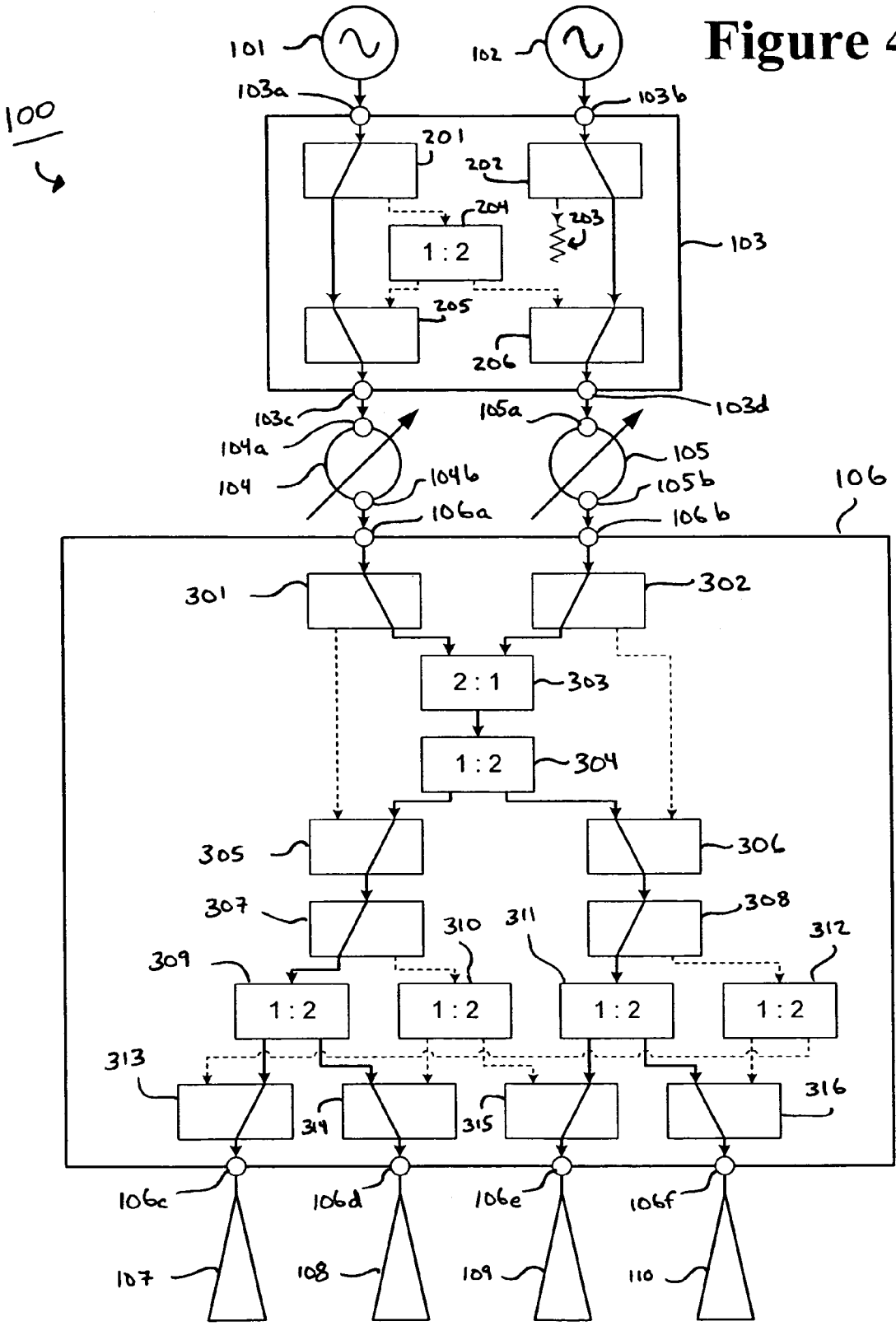
FIG. 4 illustrates a mode in which a switchable sub-group may be configured to provide control of multiple beams according to one aspect of the present invention.

FIG. 4 illustrates one mode in which sub-group 100 is configured to associate each one of waveform 101 and 102 with a corresponding one of controller circuits 104 and 105, and to further associate each one of controller circuits 104 and 105 with every one of antenna elements 107-110. Waveform signal 101 is received by first network input 103*a*, from which it passes through SPDT switch 201 to SPDT switch 205 and out through first network output 103*c*. Similarly, waveform signal 102 is received by first network input 103*b*, from which it passes through SPDT switch 202 to SPDT switch 206 and out through first network output 103*d*. In this manner, first switching network 103 associates waveform signal 101 with controller circuit 104, and waveform signal 102 with controller circuit 105.

Waveform signal 101 passes from controller circuit 104 through second network input 106*a* to SPDT switch 301, which passes waveform signal 101 to combiner 303. Similarly, waveform signal 102 passes from controller circuit 105 through second network input 106*b* to SPDT switch 302, which passes waveform signal 102 to combiner 303. Combiner 303 combines waveform signals 101 and 102, and passes the combined signal to divider 304. The combined signals pass from divider 304 to each of SPDT switches 305 and 306, which pass the signals in turn to SPDT switches 307 and 308, respectively. The signal from SPDT switch 307 is provided to divider 309, which in turn passes the divided signals to each of SPDT switches 313 and 314. The signal from SPDT switch 308 is provided to divider 311, which in turn passes the divided signals to each of SPDT switches 315 and 316. Each of SPDT switches 313-316 passes the respective signal to a corresponding one of second network outputs 106*c*-106*f*, which in turn provide the signals to a respective one of antenna elements 107-110. In this manner, second switching network 106 associates each of controller circuits 104 and 105 with every one of antenna elements 107-110.

Figure 5:
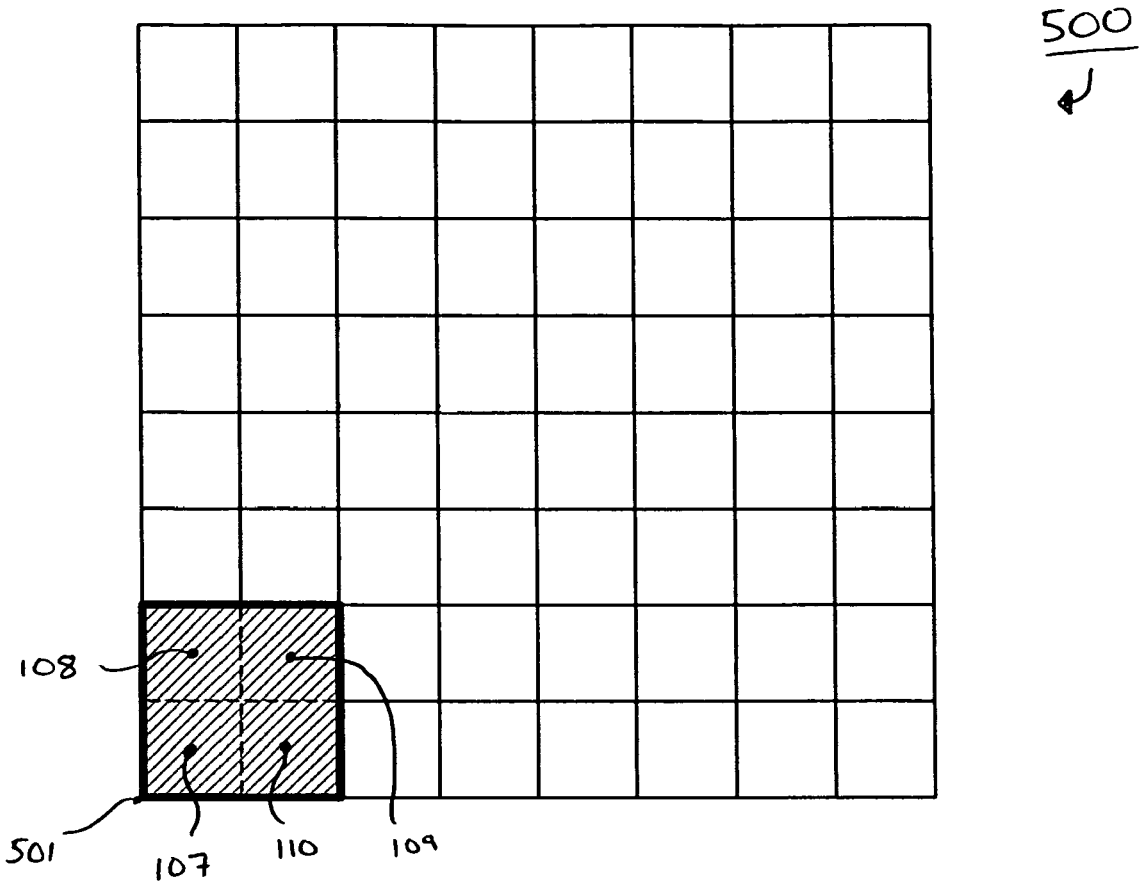
FIG. 5 illustrates a two-dimensional array in which antenna elements of the present invention may be arranged, according to one aspect of the present invention.

This arrangement permits sub-group 100 of four antenna elements 107-110 to be effectively combined into a single 2×2 sub-array 501, when antenna elements 107-110 are arranged in a two-dimensional array, as is illustrated in FIG. 5. Unlike other phased array antenna systems, in which each individual antenna element would need to be provided with two controller circuits (for a total of 8 controller circuits per sub-group) to accommodate two beams formed by two separate waveform signals, the present invention requires only two controller circuits to control two beams with four antenna elements. In a system such as phased array antenna system 500, in which 64 individual antenna elements are provided, this reduction in the amount of electronics required to control multiple beams represents a significant cost, power consumption and mass advantage.

In the present configuration, because the number of effective elements is reduced by a factor of two in both the horizontal and vertical orientation, the scanning range in both the horizontal and vertical orientations will be reduced by about half for the maximum frequency ("$F_{max}$") of the antenna system. At frequencies below $F_{max}/2$, however, no reduction in scanning range compared to $F_{max}$ will be experienced. This is particularly advantageous for wideband phased array antenna systems which may operate extensively in frequencies below $F_{max}/2$. Even taking into account the scanning limitation, however, the reduction in electronics (e.g., controller circuits) required by the present invention provides significant advantages to narrowband systems as well.

Figure 6:
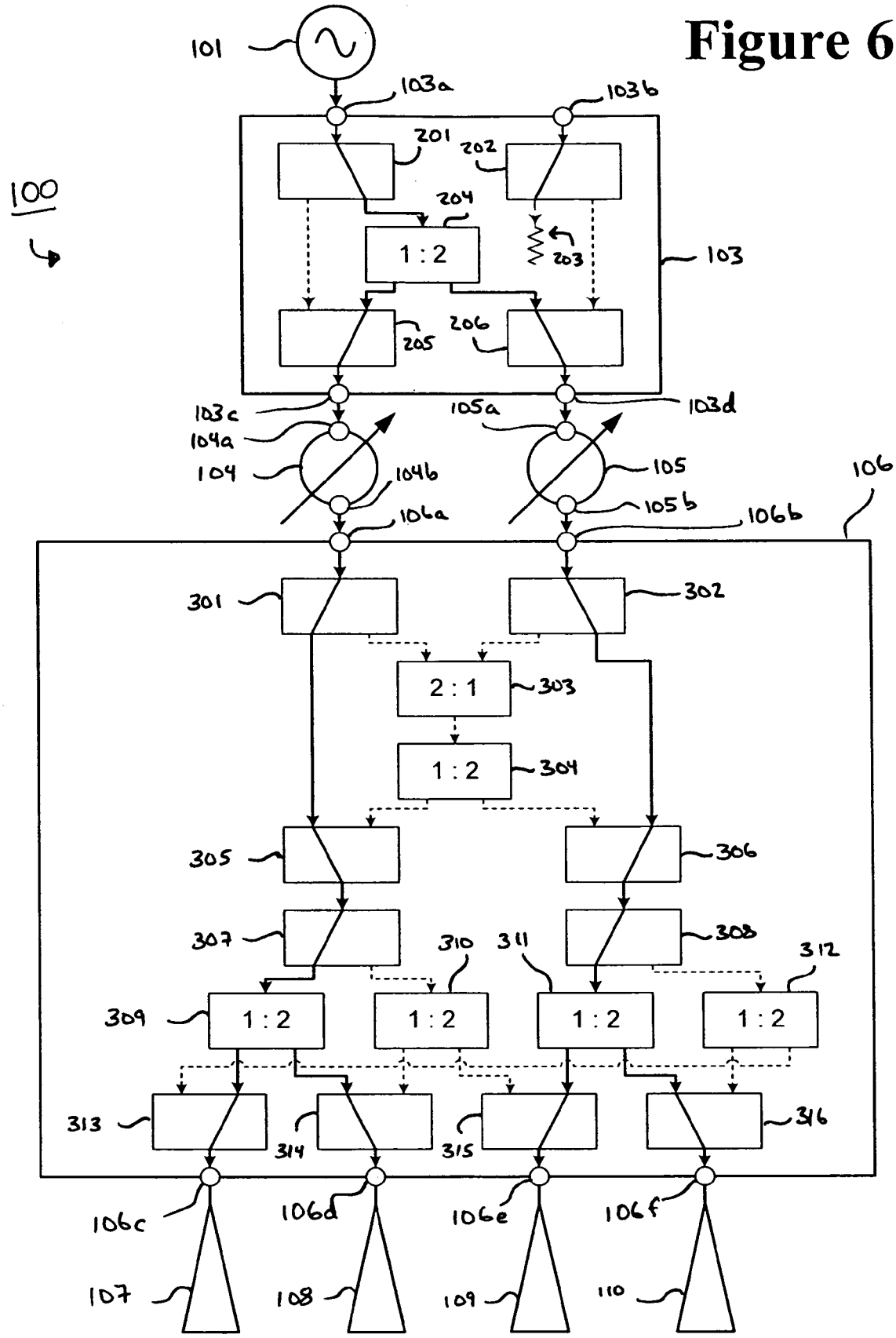
FIG. 6 illustrates a mode in which a switchable sub-group may be configured to provide greater scanning range according to one aspect of the present invention.

Turning to FIG. 6, another configuration of sub-group 100 is illustrated in which only one waveform signal is provided.

In this configuration, first switching network 103 associates waveform signal 101 with both of controller circuits 104 and 105, by routing waveform signal 101 from SPDT switch 201 to divider 204, through SPDT switches 205 and 206 and out through first network outputs 103*c* and 103*d*. SPDT switch 202 is configured to connect first network input 103*b*, which is not provided with a waveform signal, to resistor 203. Second switching network 106 is configured to connect each of controller circuits 104 and 105 with a different pair of antenna elements 107-110. In this arrangement, SPDT switches 301 and 302 are configured to pass the signals received from controller circuits 104 and 105 to SPDT switches 305 and 306, respectively, instead of combining and dividing the signals as was done in the configuration described above. SPDT switch 305 provides the signal from controller circuit 104 to SPDT switch 307, which in turn provides the signal to divider 309, which in turn provides the signal to SPDT switches 313 and 314. SPDT switch 306 provides the signal from controller circuit 105 to SPDT switch 308, which in turn provides the signal to divider 311, which in turn provides the signal to SPDT switches 315 and 316. In this manner, the second switching network 106 associates the signal from controller circuit 104 with antenna elements 107 and 108, and the signal from controller circuit 105 with antenna elements 109 and 110.

Figure 7:
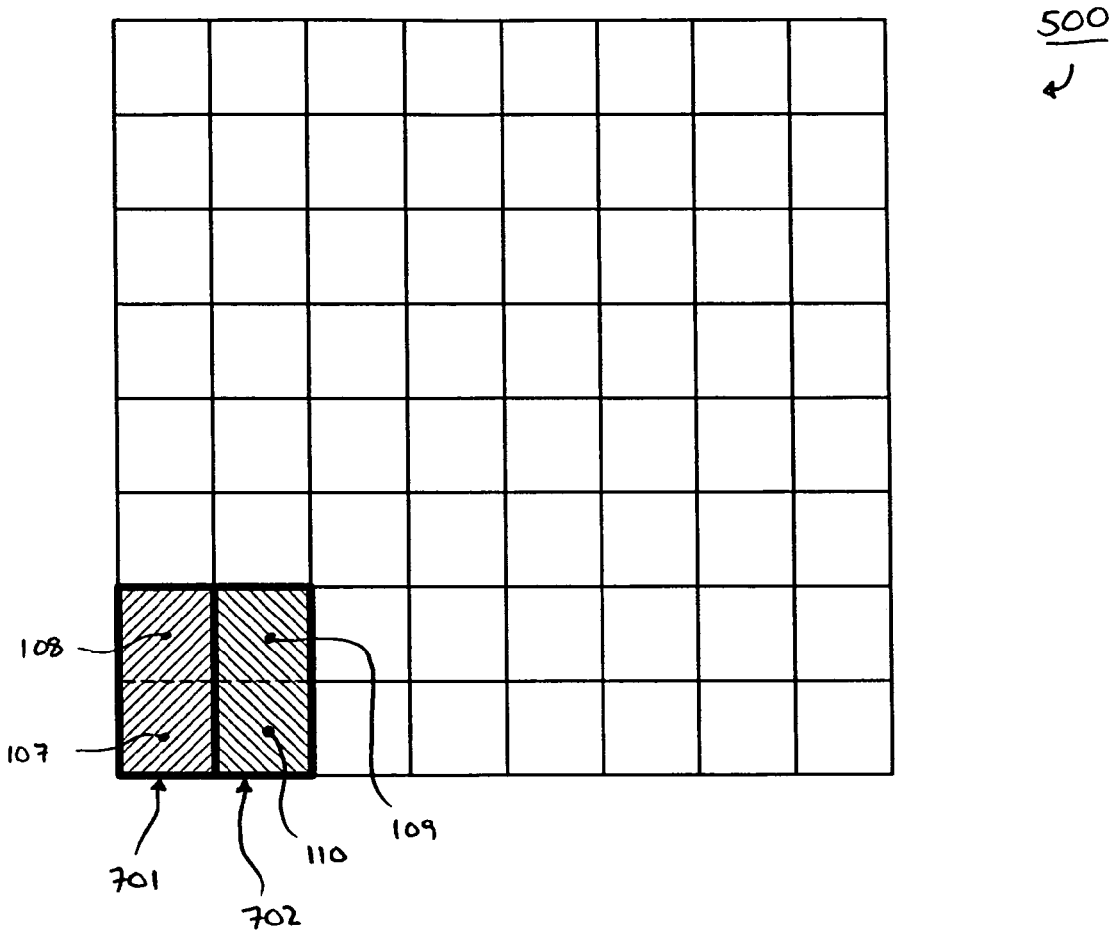
FIG. 7 illustrates a two-dimensional array in which antenna elements of the present invention may be arranged, according to one aspect of the present invention.

Turning to FIG. 7, it can be seen that the present configuration permits sub-group 100 of four antenna elements 107-110 to be effectively combined into two 1×2 sub-arrays 701 and 702. Unlike other phased array antenna systems, in which each individual antenna element would need to be provided with its own controller circuit (for a total of 4 controller circuits per sub group) to accommodate a single beam, the present invention requires only two controller circuits to provide each of two sub-arrays (having two antenna elements each) with control of a single beam.

In the present configuration, because the number of effective elements is reduced by a factor of two in the vertical orientation, the scanning range in the vertical orientation will be reduced by about half for the maximum frequency ("$F_{max}$") of the antenna system. At frequencies below $F_{max}/2$, however, no reduction in scanning range will be experienced compared to $F_{max}$.

Returning to the configuration illustrated in FIG. 6, it can be easily seen that by switching the positions of SPDT switches 307 and 308 (as well as those of SPDT switches 313-316), the signal from controller circuit 104 can be associated with antenna elements 108 and 109, and the signal from controller circuit 105 can be associated with antenna elements 107 and 110 to form two horizontally oriented 2×1 sub-arrays. In this configuration, the scanning range in the horizontal orientation will be reduced by about half for the maximum frequency ("$F_{max}$") of the antenna system. At frequencies below $F_{max}/2$, however, no reduction in scanning range compared to $F_{max}$ will be experienced.

Figure 8:
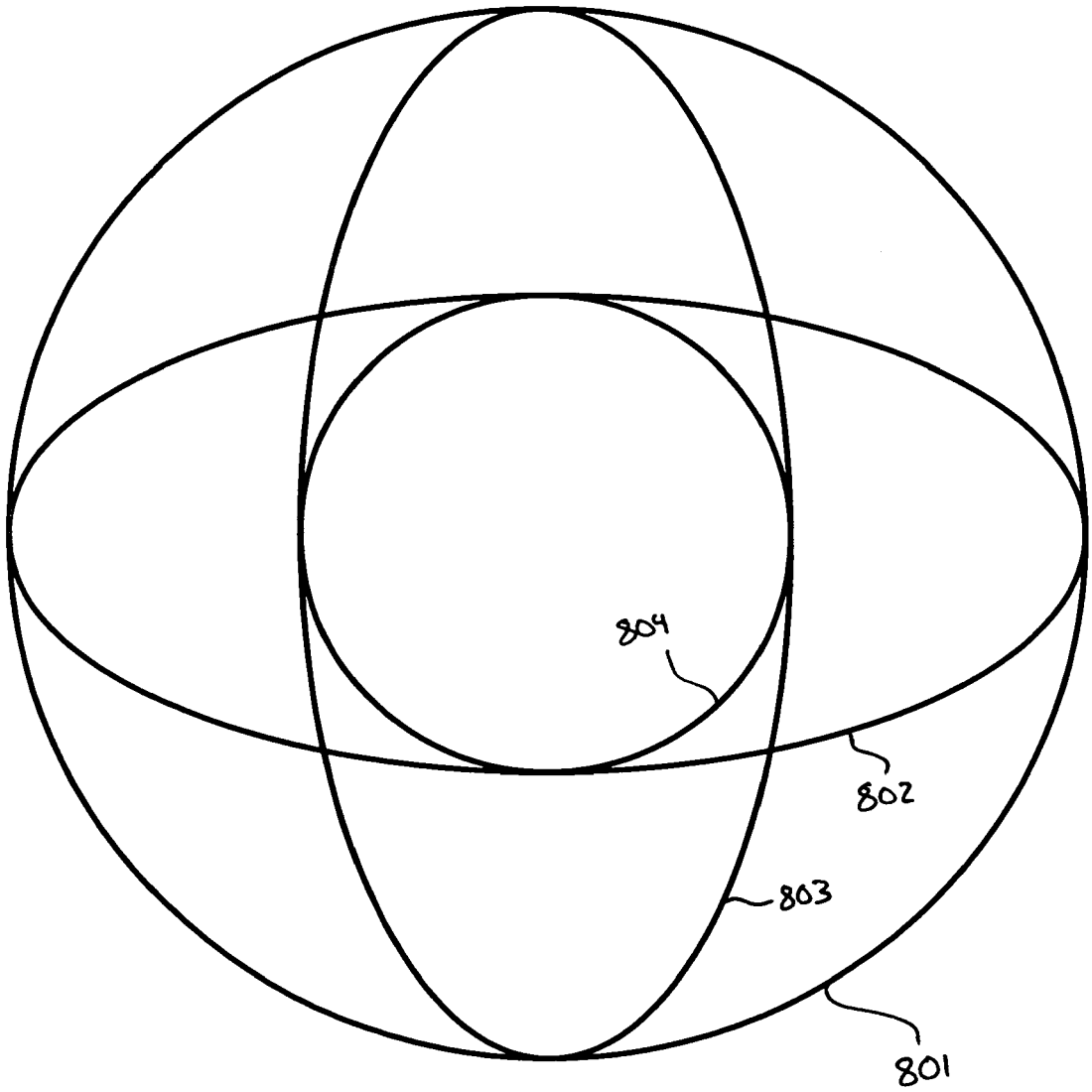
FIG. 8 illustrates the scanning ranges of a switchable sub-group in various configurations according to various aspects of the present invention.

Turning to FIG. 8, the scanning range (i.e., coverage areas) for each of the configurations described above are illustrated. In every configuration, for frequencies at or below $F_{max}/2$, the coverage area 801 is undiminished compared to a conventional phased array operating at $F_{max}$. In the configuration illustrated in FIGS. 4 and 5, in which sub-group 100 is associated into a single 2×2 sub-array providing two beams, the coverage area at $F_{max}$ is represented by coverage area 804, which is reduced by about half in both the vertical and horizontal orientations when compared to coverage area 801. In the configuration illustrated in FIGS. 6 and 7, in which sub-group 100 is associated into two vertically oriented 1×2 sub-arrays providing a single beam, the coverage area at $F_{max}$ is represented by coverage area 802, which is reduced by about half in the vertical orientation when compared to coverage area 801. In the similar configuration in which sub-group 100 is associated into two horizontally oriented 2×1 sub-arrays providing a single beam, the coverage area at $F_{max}$ is represented by coverage area 803, which is reduced by about half in the horizontal orientation when compared to coverage area 801.

Figure 9:
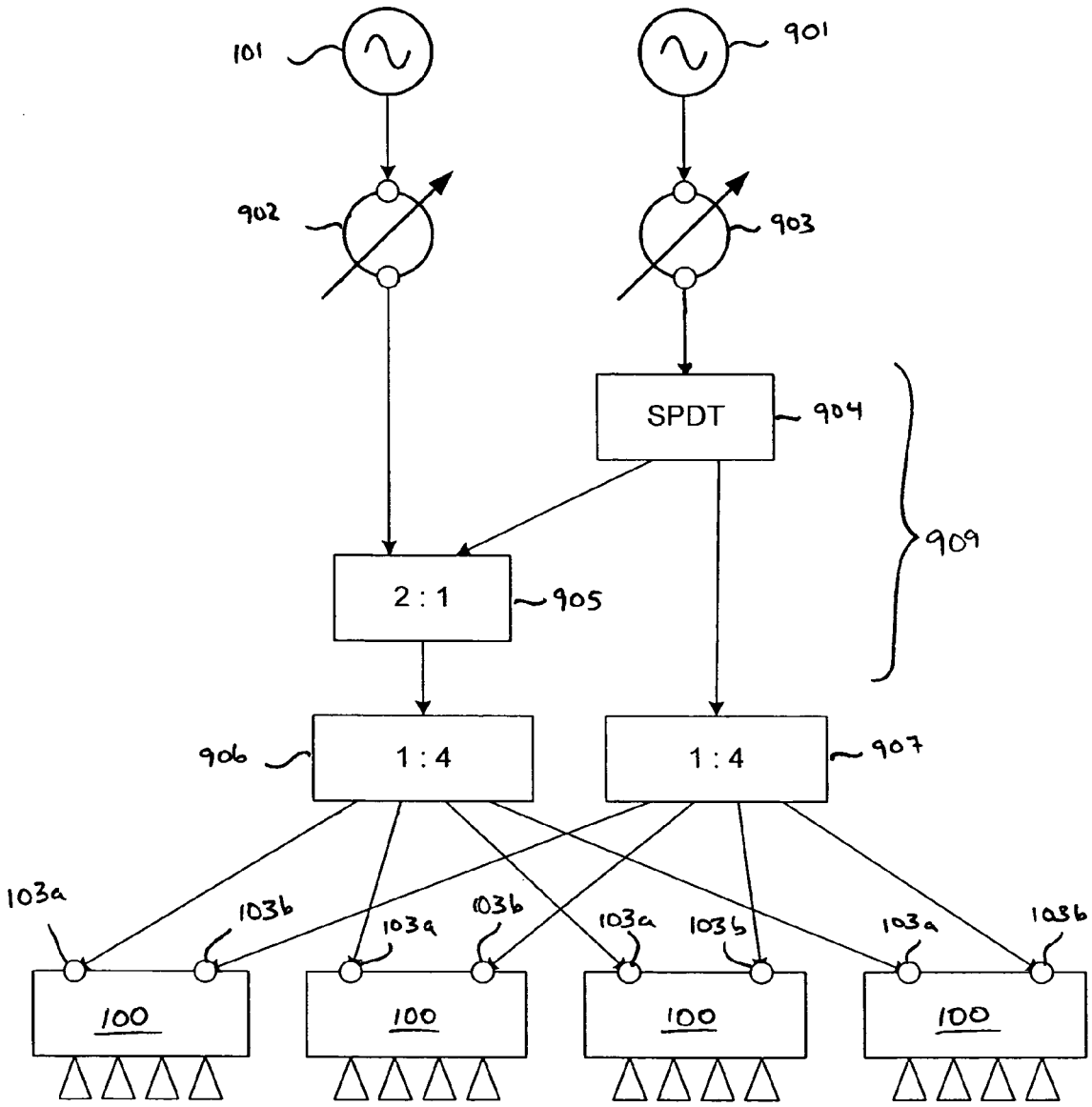
FIG. 9 illustrates a phased array antenna system having a number of sub-groups and a third switching network, according to one aspect of the present invention.

Turning to FIG. 9, a phased array antenna system including a number of sub-groups 100 is illustrated, in which a third switching network 909 is provided. According to the present exemplary embodiment, third switching network 909 includes a SPDT switch 904 and a 2:1 combiner 905. Third switching network 909, in connection with secondary dividers 906 and 907, can route a waveform signal 901 to first network inputs 103*b* of sub-groups 100, when sub-groups 100 are configured to operate as individual 2×2 sub-arrays, or alternately, third switching network 909 can combine waveform signal 901 with waveform signal 101 and provide both waveform signals 101 and 901 to first network inputs 103*a* of sub-groups 100, when sub-groups 100 are configured to operate as 2×1 or 1×2 sub-arrays.

When sub-groups 100 are configured to operate in 2×2 sub-array configurations, as described in greater detail above with reference to FIGS. 4 and 5, each first network input 103*a* receives waveform signal 101 and each first network input 103*b* receives a separate waveform signal (i.e., 102 in FIG. 4, 901 in the present Figure). To accomplish this, SPDT switch 904 is configured to pass waveform signal 901 to divider 907, which in turn provides waveform signal 901 to each first network input 103*b*. Combiner 905 receives no signal from SPDT switch 904, and accordingly passes only waveform signal 101 to divider 906, which in turn passes waveform signal 101 to each first network input 103*a*. In this configuration, each sub-group 100 provides beam control with its own internal controller circuit, and secondary controller circuits 902 and 903 need not be used, unless they are required to provide coarse time delay control.

When sub-groups 100 are configured to operate in 1×2 or 2×1 sub-array configurations, however, as described in greater detail above with reference to FIGS. 6 and 7, each first network input 103*b* receives no waveform signal. To reintroduce a second beam, third switching network 909 can switch SPDT switch 904 to combine waveform signal 901 with waveform signal 101 in combiner 905, which provides both signals to divider 906, which in turn provides both signals to each first network input 103*a*. In this arrangement, secondary controller circuits 902 and 903 can be used to control the phase and/or gain of the two beams corresponding to waveform signals 101 and 901.

By introducing an additional waveform signal 901 to sub-groups 100 with third switching network 909, while sub-groups 100 are operating in a 1×2 or 2×1 sub-array mode, the benefits of operating each sub-group 100 in this mode (i.e., greater scanning range in either the horizontal or vertical orientation, less electronic circuitry required) can be preserved, with the additional benefit of allowing for a second beam. In the present exemplary embodiment, only two additional controller circuits 902 and 903 (for a total of 10, including the two in each of the four sub-groups) are required to provide control of two beams in sixteen individual antenna elements (i.e., four in each of four sub-groups), as compared to other approaches, which would require as many as thirty two controller circuits to accomplish the same end. While this approach restricts the beam separation at $F_{max}$ (when waveform sub-groups 100 are in 1×2 or 2×1 sub-arrays) to about ⅓ or ¼ of the scanning range at $F_{max}$, the reduction in electronic circuitry (and concomitant reduction in cost, power consumption and mass) and the restoration of scanning range at lower frequencies makes this approach an attractive option for adding additional beams to a phased array antenna system of the present invention.

While the foregoing exemplary embodiment has been described as providing a phased array antenna system of the present invention control over only one additional beam, the scope of the present invention is not limited to such an arrangement. Rather, as will be apparent to one of skill in the art, a phased array antenna system of the present invention may have a third switching network capable of providing control over any number of additional beams, provided that each additional beam will require an additional secondary controller circuit and an additional secondary divider.

While the foregoing exemplary embodiment has been described with reference to multiple sub-groups all operating in the same mode (e.g., all in a 2×2 sub-array configuration, all in a 1×2 sub-array configuration, etc.), the scope of the present invention is not limited to such an arrangement. Rather, a phased array antenna system including more than one sub-group may operate each sub-group in a different configuration. This may be desirable to break up and/or randomize grating lobes and thereby improve the performance of the system.

While the foregoing exemplary embodiments have been described with reference to sub-groups in which only one or two beams are controlled, and in which only four antenna elements are provided, the scope of the present invention is not limited to such arrangements. Rather, as will be apparent to one of skill in the art, the present invention has application to sub-groups in which any number of beams are controlled, and in which any number of individual antenna elements are provided.

Figure 10:
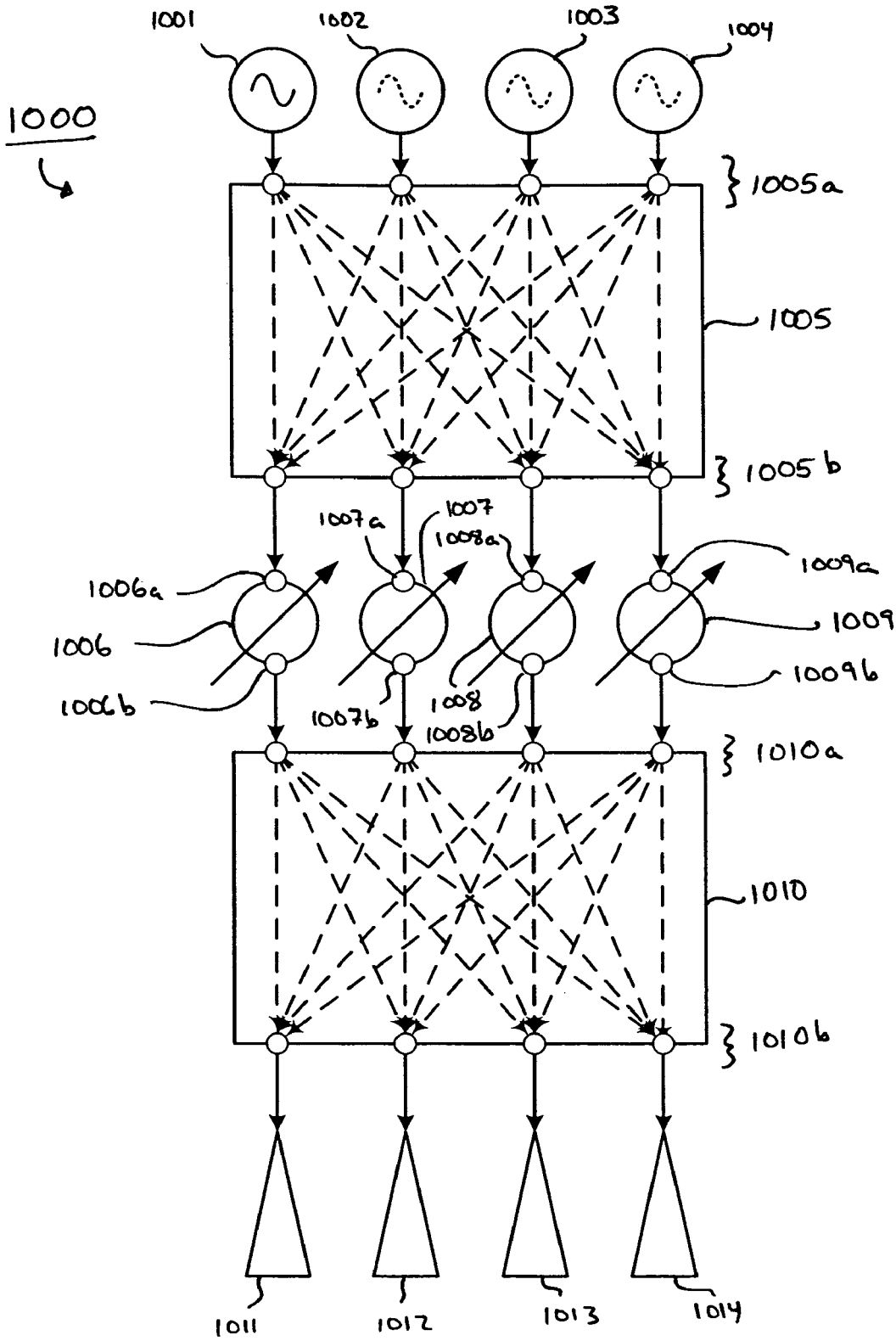
FIG. 10 depicts a switchable sub-group according to one embodiment of the present invention.

For example, FIG. 10 illustrates one such embodiment of the present invention, in which up to four beams may be controlled by a single sub-group 1000. First switching network 1005 has first network inputs 1005*a*, which are each configured to receive a corresponding waveform signal 1001-1004. Waveform signals 1002-1004 are illustrated with a dashed line to indicate that in some arrangements, these waveform signals will not be present. First switching network 1005 also includes first network outputs 1005*b*, which can be switchably associated with first network inputs 1005*a*. By switchably associating connections (indicated with dotted lines) between first network inputs 1005*a* and first network outputs 1005*b*, first switching network 1005 can switchably associate one or more of waveform signals 1001-1004 with one or more of the controller circuits 1006-1009, as has been described in greater detail above with respect to FIGS. 1 and 2. Controller circuits 1006-1009 each have corresponding controller inputs 1006*a*-1009*a* and controller outputs 1006*b*-1009*b*. Each first network output 1005*b* is coupled with a corresponding one of the controller inputs 1006*a*-1009*a*. Each controller output 1006*b*-1009*b* is coupled with a corresponding second network input 1010*a* on the second switching network 1010.

Second switching network 1010 further includes a number of second network outputs 1010*b*, which can be switchably associated with second network inputs 1010*a*. By switchably associating connections (indicated with dotted lines) between second network inputs 1010*a* and second network outputs 1010*b*, second switching network 1010 can switchably associate one or more of controller circuits 1006-1009 with one or more of the antenna elements 1011-1014, as has been described in greater detail above with respect to FIGS. 1 and 3.

For example, in one arrangement, each of waveform signals 1001-1004 are provided to a corresponding one of controller circuits 1006-1009. Each controller circuit 1006-1009 is then associated with every one of antenna elements 1011-1014. In this arrangement, sub group 1000 is configured as a 2×2 sub-array controlling four beams, with a scanning range reduced by about ½ at $F_{max}$, as described more fully above.

In another arrangement, only waveform signals 1001 and 1004 are provided. Each is associated with a different two of controller circuits 1006-1009 (e.g., waveform signal 1001 is associated with controller circuits 1006 and 1007, and waveform signal 1004 is associated with controller circuits 1008 and 1009). Second switching network 1010 is configured to associate controller circuits 1006 and 1008 with antenna elements 1011 and 1012, and to associate controller circuits 1007 and 1009 with antenna elements 1013 and 1014. In this manner, sub-group 1010 is configured as a pair of 1×2 vertically oriented sub-arrays, each controlling two beams, with a scanning range in the vertical orientation reduced by about ½ at $F_{max}$, as described more fully above with reference to FIGS. 6 and 7. In a similar fashion, sub-group 1010 may be configured as a pair of 2×1 horizontally oriented sub-arrays, each controlling two beams, analogously to the sub-group 100 described above.

Finally, in yet another arrangement, only waveform signal 1001 is provided. First switching network 1005 associates waveform signal 1001 with each one of controller circuits 1006-1009. Second switching network associates each one of controller circuits 1006-1009 with a corresponding one of antenna elements 1011-1014. In this arrangement, sub-group 1000 is configured as four separate elements, each controlling one beam and having no reduction in scanning range.

While in the foregoing exemplary embodiments, sub-groups of the present invention have been described with reference to 2×2, 1×2 and 2×1 sub-arrays, the scope of the present invention is not limited to these particular arrangements. As will be apparent to one of skill in the art, a sub-group of the present invention may be configured by first and second switching networks to operate in any one of a number of configurations, including 1×3, 2×3, 3×3, 3×2, 3×1, 1×4, 2×4 and 3×4 arrays, and the like. The reduction in scanning range at $F_{max}$ for a given configuration is determined by the factor by which the number of effective elements in that orientation is reduced. For example, in a 1×3 vertically oriented sub-array, the scanning range in the vertical orientation at $F_m$ will be reduced by a factor of 3. At frequencies below $F_{max}/3$, the full scanning range in the vertical orientation will be restored.

In light of the above, the various configurations of a sub-group according to the present invention can be described mathematically as follows. A first switching network 1005 has X first network inputs and M first network outputs, each first network outputs corresponding to one of M controller circuits. Each one of the M controller circuits corresponds to one of M second network inputs on a second switching network. Second switching network also has N second network outputs, each corresponding to one of N antenna elements. Depending upon the number of waveform signals provided to first switching network, the configuration of a sub-group may provide beam control for as many as M beams. Where the number of waveform signals provided is a fraction of M, such as M/Y, then the number of sub-arrays into which the sub-group may be divided is Y.

For example, in the arrangement described with reference to FIG. 10, X=4, M=4, and N=4. When 4 waveform signals are provided (M/Y=4/1=4), then the sub-group is configured as 1 (i.e., Y=1) sub-array. When only 2 waveform signals are provided (M/Y=4/2=2), then the sub-group is divided into 2 (i.e., Y=2) sub-arrays. When only 1 waveform signal is provided (M/Y=4/4=1), then the sub-group is divided into four (i.e., Y=4) sub-arrays.

To maximize the efficiency of a phased array antenna system of the present invention, the number and arrangement of sub-groups and sub-arrays should be chosen so as to ensure that X, M, and N are evenly divisible by Y. Nevertheless, the scope of the present invention is not limited to arrangements in which M/Y is an integer.

While the foregoing exemplary embodiments have been described with a waveform signal proceeding to an antenna element to be transmitted, the scope of the present invention is not limited to such an arrangement. Rather, as will be apparent to one of skill in the art, the present invention may be utilized in receive mode, as well. When operating in receive mode, dividers will act as combiners, combiners will act as dividers, inputs will act as outputs, and outputs will act as inputs. For the purposes of this application, the term "divider" will be understood to perform both the functions of dividing and of combining. Similarly, the term "combiner" will be understood to perform both the functions of combining and of dividing. Moreover, because of the direction in which signals flow in a transmit embodiment, switching networks 103 and 106 have heretofore been described as "first" and "second" switching networks, respectively. In a receive implementation, however, a switching network disposed between the antenna elements and the controller circuits may be referred to as a "first" switching network, and a switching network located between the controller circuits and the waveform signals may be referred to as a "second" switching network.

Figure 11:
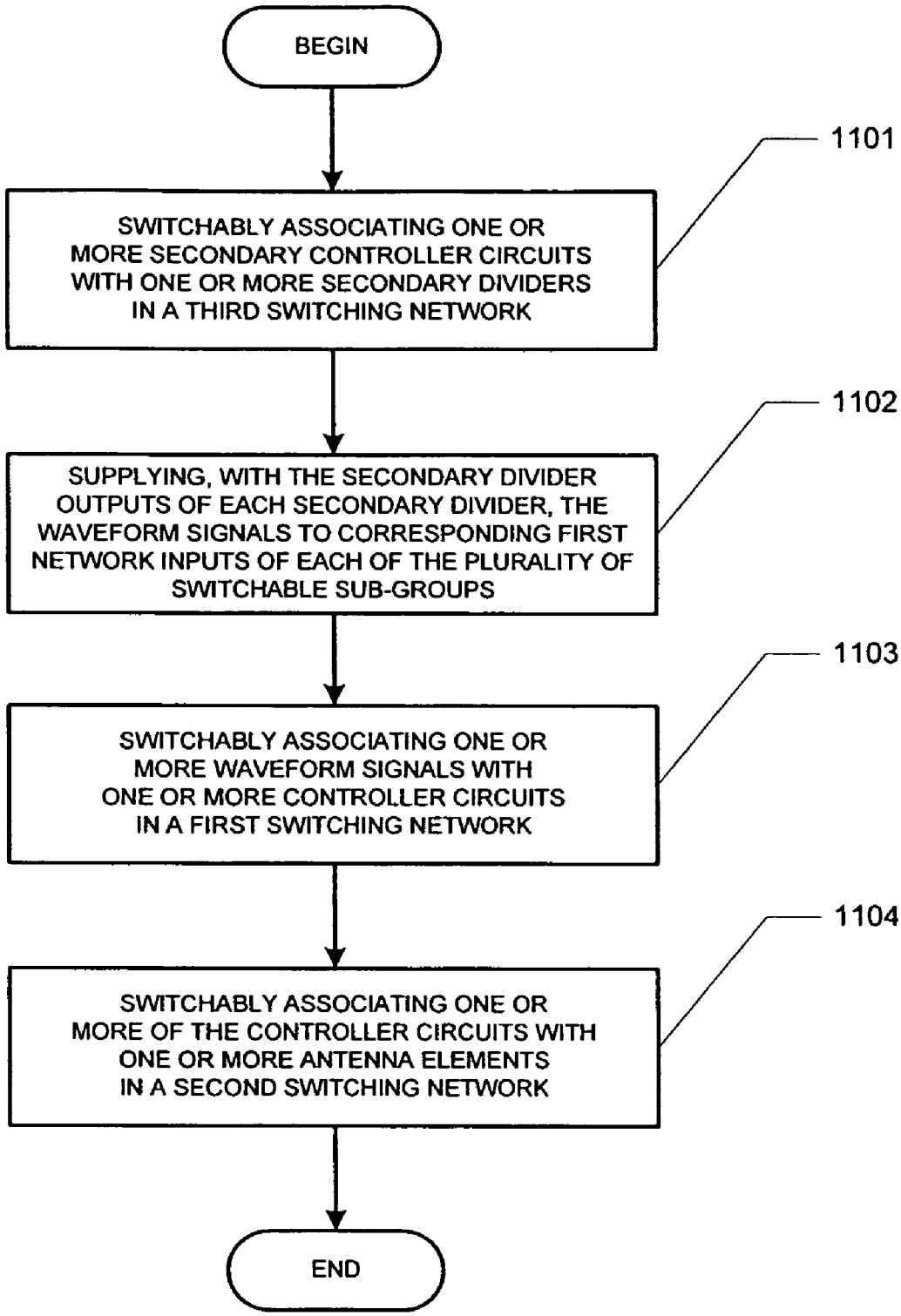
FIG. 11 is a flow chart depicting process steps for switchably associating waveform signals with antenna elements in a sub-group of a phased array antenna system according to one embodiment of the present invention.

FIG. 11 is a flow chart depicting process steps for switchably associating waveform signals with antenna elements in a sub-group of a phased array antenna system according to one embodiment of the present invention. In a phased array antenna system having more than one sub-group and in which a third switching network is utilized, the method begins with step 1101. For phased array antenna systems in which a third switching network is not provided or not used, the method begins in step 1103. In step 1101, one or more secondary controller circuits are switchably associated, in a third switching network, with one or more of a plurality of secondary dividers, each of which has a plurality of secondary divider outputs. In step 1102, the secondary divider outputs of each secondary divider supply the waveform signals to corresponding first network inputs of each of the plurality of switchable sub-groups. In step 1103, a first switching network is used to switchably associate one or more of the waveform signals with one or more of M controller circuits by switchably associating connections between the X first network inputs and the M first network outputs. In step 1104, a second switching network is used to switchably associate one or more of the M controller circuits with one or more of N antenna elements by switchably associating connections between the M second network inputs and the N second network outputs.

Figure 12:
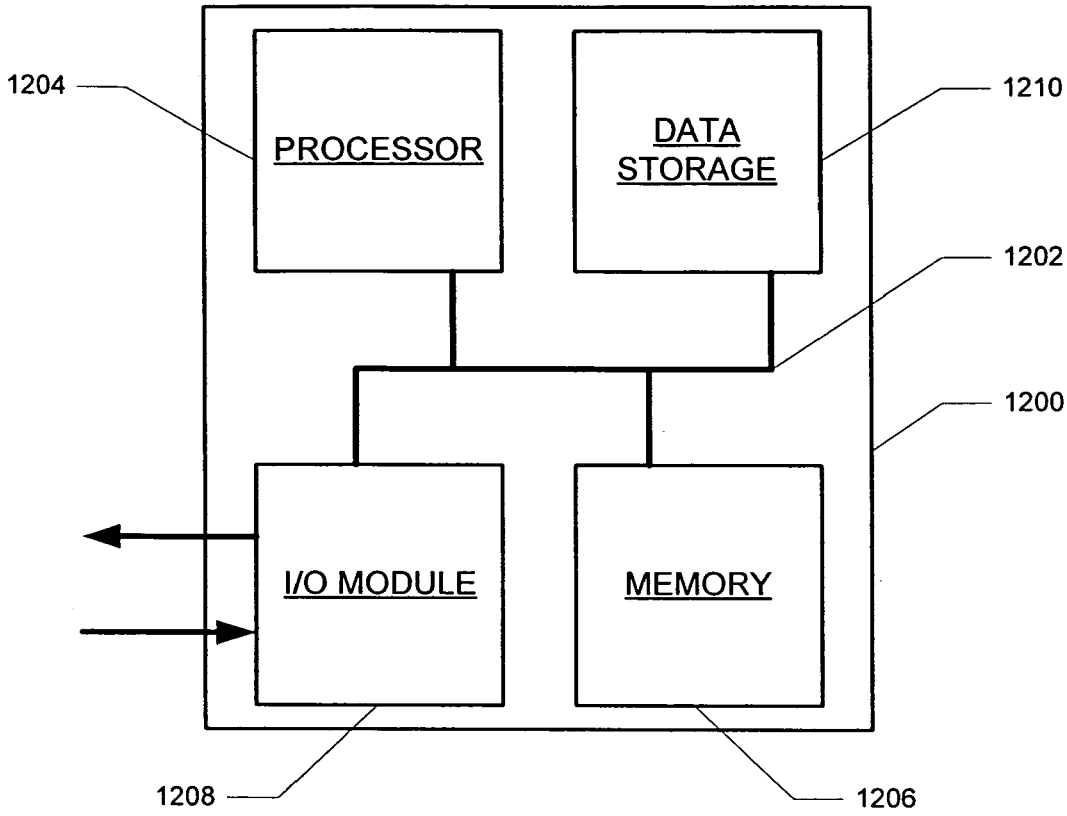
FIG. 12 is a block diagram that illustrates a computer system upon which an embodiment of the present invention may be implemented.

FIG. 12 is a block diagram that illustrates a computer system 1200 upon which an embodiment of the present invention may be implemented. Computer system 1200 includes a bus 1202 or other communication mechanism for communicating information, and a processor 1204 coupled with bus 1202 for processing information. Computer system 1200 also includes a memory 1206, such as a random access memory ("RAM") or other dynamic storage device, coupled to bus 1202 for storing information and instructions to be executed by processor 1204. Memory 1206 may also be used for storing temporary variable or other intermediate information during execution of instructions to be executed by processor 1204. Computer system 1200 further includes a data storage device 1210, such as a magnetic disk or optical disk, coupled to bus 1202 for storing information and instructions.

Computer system 1200 may be coupled via I/O module 1208 to a display device (not illustrated), such as a cathode ray tube ("CRT") or liquid crystal display ("LCD") for displaying information to a computer user. An input device, such as, for example, a keyboard or a mouse may also be coupled to computer system 1200 via I/O module 1208 for communicating information and command selections to processor 1204.

According to one embodiment of the invention, switchably associating waveform signals with antenna elements in a sub-group is performed by a computer system 1200 in response to processor 1204 executing one or more sequences of one or more instructions contained in memory 1206. Such instructions may be read into memory 1206 from another computer-readable medium, such as data storage device 1210. Execution of the sequences of instructions contained in main memory 1206 causes processor 1204 to perform the process steps described herein. One or more processors in a multi-processing arrangement may also be employed to execute the sequences of instructions contained in memory 1206. In alternative embodiments, hard-wired circuitry may be used in place of or in combination with software instructions to implement the invention. Thus, embodiments of the invention are not limited to any specific combination of hardware circuitry and software.

For example, computer system 1200 may receive waveform signals, such as waveform signals 101 and 102, through I/O module 1208 and process them (e.g., by switchably associating them with one or more controllers, which may be implemented in software, firmware, or hardware of computer system 1200) to provide output signals through I/O module 1208 to drive antenna elements, such as antenna elements 107-110. In this manner, with appropriate analog-to-digital and digital-to-analog converters, computer system 1200 can perform all of the functions of first switching network 103, controller circuits 104 and 105, and second switching network 106 in the digital domain. Alternatively, computer system 1200 can perform less than all of these functions, and route signals through I/O module 1208 to other elements of a phased array antenna system, such as separate controller circuits, to perform some of these functions in the analog domain.

The term "computer-readable medium" as used herein refers to any medium that participates in providing instructions to processor 1204 for execution. Such a medium may take many forms, including, but not limited to, non-volatile media, volatile media, and transmission media. Non-volatile media include, for example, optical or magnetic disks, such as data storage device 1210. Volatile media include dynamic memory, such as memory 1206. Transmission media include coaxial cables, copper wire, and fiber optics, including the wires that comprise bus 1202. Transmission media can also take the form of acoustic or light waves, such as those generated during radio frequency and infrared data communications. Common forms of computer-readable media include, for example, floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH EPROM, any other memory chip or cartridge, a carrier wave, or any other medium from which a computer can read.

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope of the invention.

What is claimed is:

1. A phased array antenna system including one or more switchable sub-groups, each switchable sub-group comprising:

M controller circuits, where M is a positive integer greater than one, each controller circuit having a controller input and a controller output;

a first switching network having X first network inputs, where X is a positive integer greater than one, each first network input being configured to receive a waveform signal, the first switching network having M first network outputs, each first network output corresponding to one of the M controller inputs, the first switching network being configured to switchably associate one or more of the waveform signals with one or more of the M controller circuits by switchably associating connections between the X first network inputs and the M first network outputs;

N antenna elements, where N is a positive integer greater than one; and a second switching network disposed between the M controller circuits and the N antenna elements, the second switching network having M second network inputs, each second network input corresponding to one of the M controller outputs, the second switching network having N second network outputs, each second network output corresponding to one of the N antenna elements, the second switching network being configured to switchably associate one or more of the M controller circuits with one or more of the N antenna elements by switchably associating connections between the M second network inputs and the N second network outputs, wherein the second switching network includes one or more switches and at least one of a combiner and a divider by which the M second network inputs are switchably associated with the N second network outputs.

2. The phased array antenna system of claim 1, wherein the M controller circuits are configured to control a phase, a gain, a time delay or an amplitude of one or more of the waveform signals.

3. The phased array antenna system of claim 1, wherein the N antenna elements of the one or more switchable sub-groups are arranged in a two dimensional array.

4. The phased array antenna system of claim 1, wherein the first switching network includes one or more switches, combiners and/or dividers by which the X first network inputs are associated with the M first network outputs.

5. The phased array antenna system of claim 1, wherein X=M, and wherein each first network input is provided with a discrete waveform signal, and wherein the first switching network is configured to associate each waveform signal received by each first network input with a different one of the M controller circuits, and wherein the second switching network is configured to associate each one of the M controller circuits with every one of the N antenna elements.

6. The phased array antenna system of claim 1, wherein M/Y of the X first network inputs are provided with a discrete waveform signal, where Y is a positive integer by which M and N are evenly divisible, and wherein the first switching network is configured to associate each of the M/Y first network inputs with Y of the M controller circuits, and wherein the second switching network is configured to associate each one of the M controller circuits with N/Y of the N antenna elements.

7. The phased array antenna system of claim 1, wherein the phased array antenna system includes a plurality of switchable sub-groups, further comprising:

a plurality of secondary controller circuits;

a plurality of secondary dividers, each secondary divider having a plurality of secondary divider outputs; and a third switching network configured to switchably associate one or more of the plurality of secondary controller circuits with one or more of the plurality of secondary dividers, wherein the secondary divider outputs of each secondary divider are configured to supply waveform signals to corresponding first network inputs of each of the plurality of switchable sub-groups.

8. The phased array antenna system of claim 1, wherein the phased array antenna system includes a plurality of switchable sub-groups, and wherein one or more of the plurality of switchable sub-groups is configured to operate in a different configuration than another one of the plurality of switchable sub-groups.

9. A phased array antenna system including one or more switchable sub-groups, each switchable sub-group comprising:

N antenna elements, where N is a positive integer greater than one, each antenna element being configured to receive an input signal;

M controller circuits, where M is a positive integer greater than one, each controller circuit having a controller input and a controller output;

a first switching network disposed between the N antenna elements and the M controller circuits, the first switching network having N first network inputs, each first network input corresponding to one of the N antenna elements, the first switching network having M first network outputs, each first network output corresponding to one of the M controller circuits, the first switching network being configured to switchably associate one or more of the N antenna elements with one or more of the M controller circuits by switchably associating connections between the N first network inputs and the M first network outputs, the first switching network including one or more switches and at least one of a combiner and a divider by which the N first network inputs are switchably associated with the M first network outputs; and a second switching network having M second network inputs, each second network input corresponding to one of the M controller outputs, the second switching network having X second network outputs, where X is a positive integer greater than one, each second network output being configured to output a waveform signal, the second switching network being configured to switchably associate one or more of the M controller circuits with one or more of the waveform signals by switchably associating connections between the M second network inputs and the X second network outputs.

10. A phased array antenna system including one or more switchable sub-groups, each switchable sub-group comprising:

M controller circuits, where M is a positive integer greater than one, each controller circuit having a controller input and a controller output;

a first switching network having X first network inputs, where X is a positive integer greater than one, each first network input being configured to receive a waveform signal, the first switching network having M first network outputs, each first network output corresponding to one of the M controller inputs; and N antenna elements, where N is a positive integer greater than one;

a second switching network disposed between the M controller circuits and the N antenna elements, the second switching network having M second network inputs, each second network input corresponding to one of the M controller outputs, the second switching network having N second network outputs, each second network output corresponding to one of the N antenna elements, wherein the phased array antenna system further includes one or more processors configured to perform the steps of:

switchably associating, in the first switching network of each switchable sub-group, one or more of the waveform signals with one or more of the M controller circuits by switchably associating connections between the X first network inputs and the M first network outputs, and switchably associating, in the second switching network of each switchable sub-group, one or more of the M controller circuits with one or more of the N antenna elements by switchably associating connections between the M second network inputs and the N second network outputs, wherein the second switching network includes one or more switches and at least one of a combiner and a divider by which the M second network inputs are switchably associated with the N second network outputs.

11. The phased array antenna system of claim 10, wherein the M controller circuits, the first switching network and the second switching network are implemented in software or firmware.

12. The phased array antenna system of claim 10, wherein the one or more processors are configured to further perform the step of controlling a phase, a gain, a time delay or an amplitude of one or more of the waveform signals with the M controller circuits.

13. The phased array antenna system of claim 10, wherein the N antenna elements of the one or more switchable sub-groups are arranged in a two dimensional array.

14. The phased array antenna system of claim 10, wherein the first switching network includes one or more switches, combiners and/or dividers by which the X first network inputs are associated with the M first network outputs.

15. The phased array antenna system of claim 10, wherein X=M, and wherein each first network input is provided with a discrete waveform signal, and wherein the first switching network associates each waveform signal received by each first network input with a different one of the M controller circuits, and wherein the second switching network associates each one of the M controller circuits with every one of the N antenna elements.

16. The phased array antenna system of claim 10, wherein M/Y of the X first network inputs are provided with a discrete waveform signal, where Y is a positive integer by which M and N are evenly divisible, and wherein the first switching network associates each of the M/Y first network inputs with Y of the M controller circuits, and wherein the second switching network associates each one of the M controller circuits with N/Y of the N antenna elements.

17. The phased array antenna system of claim 10, wherein the phased array antenna system includes a plurality of switchable sub-groups, and wherein the one or more processors is configured to further perform the steps of:

switchably associating, in a third switching network, one or more of a plurality of secondary controller circuits with one or more of a plurality of secondary dividers, each secondary divider having a plurality of secondary divider outputs, supplying, with the secondary divider outputs of each secondary divider, waveform signals to corresponding first network inputs of each of the plurality of switchable sub-groups.

18. The phased array antenna system of claim 10, wherein the phased array antenna system includes a plurality of switchable sub-groups, and wherein one or more of the plurality of switchable sub-groups operates in a different configuration than another one of the plurality of switchable sub-groups.

* * * * *